US008162179B2

(12) United States Patent
Willner et al.

(10) Patent No.: US 8,162,179 B2
(45) Date of Patent: Apr. 24, 2012

(54) PACKAGE WITH A BAG AND A HEAD PART

(75) Inventors: Ralf Willner, Tussenhausen (DE); Herbert Ginter, Kaufbeuren (DE)

(73) Assignee: Hilti Aktiengesellschaft, Schaan (LI)

( * ) Notice: Subject to any disclaimer, the term of this patent is extended or adjusted under 35 U.S.C. 154(b) by 1120 days.

(21) Appl. No.: 12/012,287

(22) Filed: Jan. 31, 2008

(65) Prior Publication Data

US 2008/0187253 A1 Aug. 7, 2008

(30) Foreign Application Priority Data

Feb. 1, 2007 (DE) ..... 10 2007 000 066

(51) Int. Cl.
*B67D 1/00* (2006.01)

(52) U.S. Cl. ..... 222/82; 222/94; 222/105; 239/327

(58) Field of Classification Search ..... 222/88, 222/94, 105, 81, 82, 80; 239/309, 323, 327, 239/328

See application file for complete search history.

(56) References Cited

U.S. PATENT DOCUMENTS

| | | | | |
|---|---|---|---|---|
| 5,697,524 | A * | 12/1997 | Sedlmeier | 222/82 |
| 6,012,610 | A * | 1/2000 | Pauser et al. | 222/88 |
| 6,129,244 | A * | 10/2000 | Horth | 222/94 |
| 6,352,177 | B1 * | 3/2002 | Bublewitz et al. | 222/82 |
| 6,394,643 | B1 | 5/2002 | Bublewitz et al. | |
| 6,564,970 | B1 | 5/2003 | Walch et al. | |
| 6,644,509 | B1 | 11/2003 | Bublewitz et al. | |

FOREIGN PATENT DOCUMENTS

DE 9501255 3/1995

OTHER PUBLICATIONS

European Search Report.

* cited by examiner

*Primary Examiner* — Dinh Nguyen
*Assistant Examiner* — Viet Le
(74) *Attorney, Agent, or Firm* — Ableman, Frayne & Schwab

(57) ABSTRACT

A package (11) has at least one bag (12, 13) and a head part (16) having a bottom part (17, 37) including a recess (19; 39), an outlet opening (20, 40) and an elevation (22, 42) which at least partially encloses a rim area of the recess (19; 39) and which projects over the bottom part (17, 37) axially toward the bag (12, 13), and a piercing device (21, 41) for the bag (12, 13).

7 Claims, 3 Drawing Sheets

PACKAGE WITH A BAG AND A HEAD PART

BACKGROUND OF THE INVENTION

1. Field of the Invention

Figure 1:
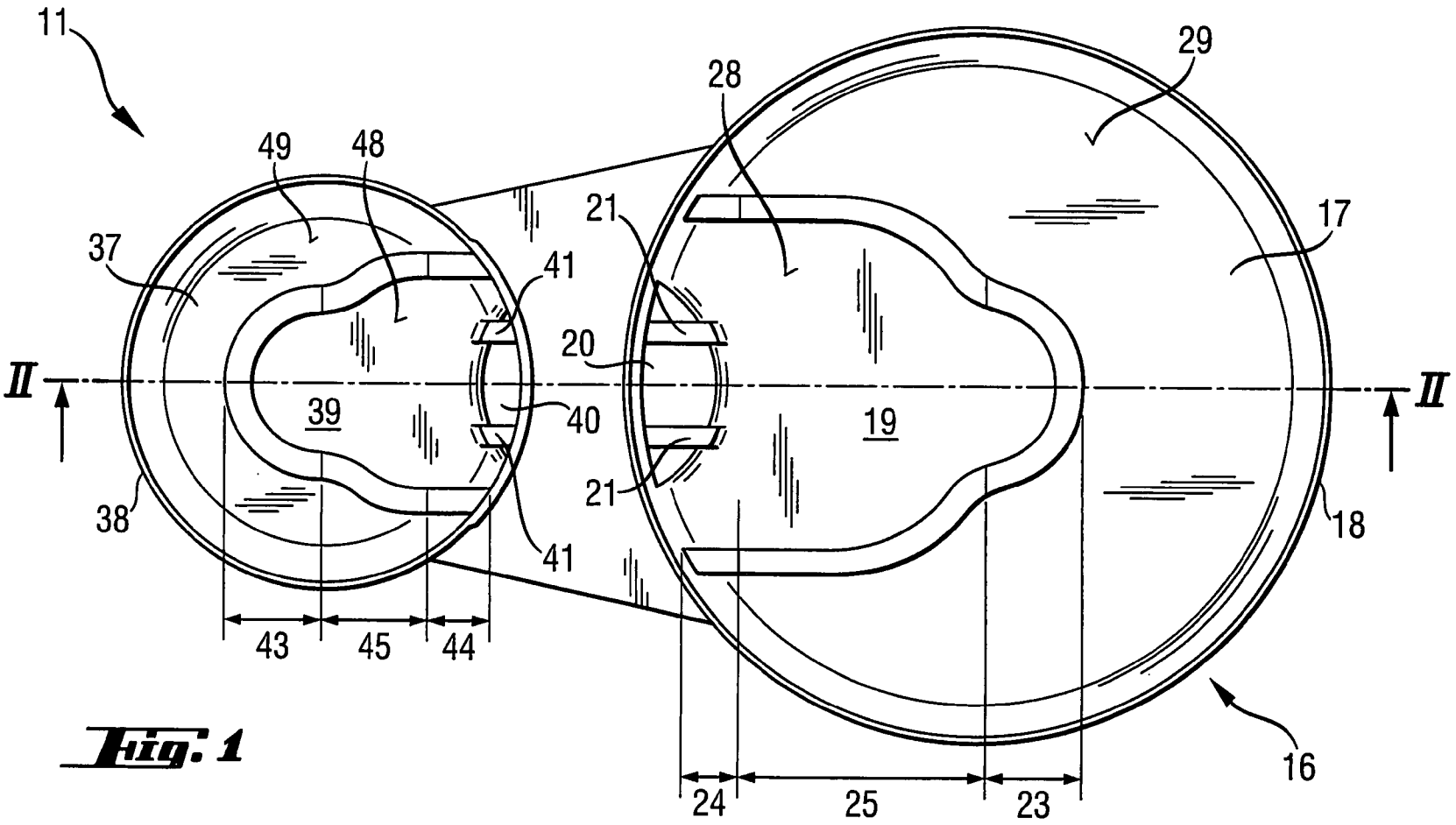

The present invention relates to a package with at least one bag and a head part having a bottom part with a recess and an outlet opening, and a piercing device for the bag.

2. Description of the Prior Art

Packages of the type mentioned above are used for dispensing and storing substances, in particular hardenable substances such as mortar substances, putty substances, sealing substances, adhesive substances, and the like in single-component or multi-component form. For example, fastening elements are chemically anchored in previously drilled bore holes in a substrate, e.g., a mineral substrate such as concrete or masonry, by means of a hardenable substance which is dispensed from the package.

The substance which is stored in the bag is opened directly at the place of use and is dispensed from the package with a press-out device adapted to the package. After the package is emptied, it is replaced with a new package. Packages with a bag and a head part are widely used as representing flexible, reliable and economical packagings for the substances to be pressed out.

However, opening the bag which is formed, for example, as a foil bag presents a substantial challenge. Particularly in the case of multi-component substances, the individual components may only come into contact with one another shortly before applying the substance. Further, the influx of air can change the properties of the substance stored in the bag.

DE 295 01 255 U1 discloses a package for a two-component substance with two bags and a head part having a bottom part with a recess, an outlet opening, and a piercing device in the form of two piercing spatulas for each bag. The piercing spatulas extend along one another and parallel to one another approximately parallel to the axis of the outlet opening, and are arranged inside the axial projection of the outlet opening. The bag is supported radially and axially by this arrangement of the piercing spatulas. A pressure applied to the bag by a press-out device results in a local overexpansion of the area of the bag between the piercing spatulas until the bag bursts over a large surface.

In certain cases, when opening the bag in the known solution, the bag is only perforated by the piercing device and therefore does not burst to the desired extent. This may lead to small holes in the bag which block the passage of the substance to be applied so that the press-out pressure required for pressing out the substance is significantly increased. Accordingly, in the case of multi-component substances, inhomogeneous mixing may possibly result.

SUMMARY OF THE INVENTION

It is the object of the invention to provide a package with a bag and a head part that facilitates opening of the bag.

According to the invention, an elevation which at least partially encloses a rim area of the recess and which projects over the bottom part axially toward the bag is provided at the bottom part.

The elevation forms an axial support for the bag that is fixed to the head part. When pressed against by the package, the bag is tensioned between the elevation and the bottom before contacting the piercing device and is then ripped by the latter in the pretensioned state. Owing to the pretensioning which is applied beforehand, the ripping of the bag in the opening area is improved compared to known solutions, which ensures that the holes that are formed are sufficiently large for the to-be-applied substance to flow through.

In addition, the elevation prevents the applied substance from flowing backward out of the recess in the bottom part so that substantially the entire amount of substance can be dispensed, excluding a small residual amount.

Further, when the bag is fixed in the head part, the elevation forms a stop which assists in a correct mounting of the bag. The bag is fixed in the head part by a glue connection, for example.

The minimum axial height of the elevation preferably corresponds to the axial height of the piercing device so that the bag does not contact the piercing device in the fixed state. Accordingly, the application of pressure to the bag ensures that the bag is pretensioned in the opening area before this opening area comes into contact with the piercing device and is pierced.

The head part advantageously has a circumferential rim with an axial height, and the maximum axial height of the elevation corresponds to one half of the axial height of the rim. Along with the bottom part, the circumferential rim of the head part forms a receptacle for an end area of the bag. By limiting the maximum height of the elevation to one half of the axial height of the rim, there is a sufficiently large contact surface between the head part and the bag to secure the latter to the head part.

The elevation preferably has a first area with a first axial height and a second area with a second axial height, which is greater than the first axial height, and a portion connecting the two areas. The first area of the elevation is advantageously provided at the radial inner side of the bottom part. Owing to the construction of the elevation, the end area of the bag makes contact along it entire extension in the mounted state, which leads to an advantageous pretensioning of the bag in the opening area before contacting the piercing device when the bag is acted upon.

The portion connecting the two areas preferably has a continuously extending axial rim so that an advantageous contact edge is created for the bag that is fixed in the head part.

The package preferably has at least two bags and the head part has at least two bottom parts. At least one bottom part has an elevation which at least partially surrounds the recess and projects axially over the respective bottom part. A package of this kind serves to dispense and store multi-component substances. The head part is advantageously formed of one piece. Alternatively, the head part can be formed of a plurality of parts so that, for example, individual components of a multi-component substance can be combined when needed, and the plurality of parts can be assembled to form a package. A head part, which can be assembled in a modular manner, advantageously has correspondingly formed connection means such as, for example, snap elements.

Each bottom part preferably has an elevation which at least partially surrounds the recess and projects axially over the bottom part so as to ensure an advantageous opening of each bag.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE INVENTION

Figure 2:
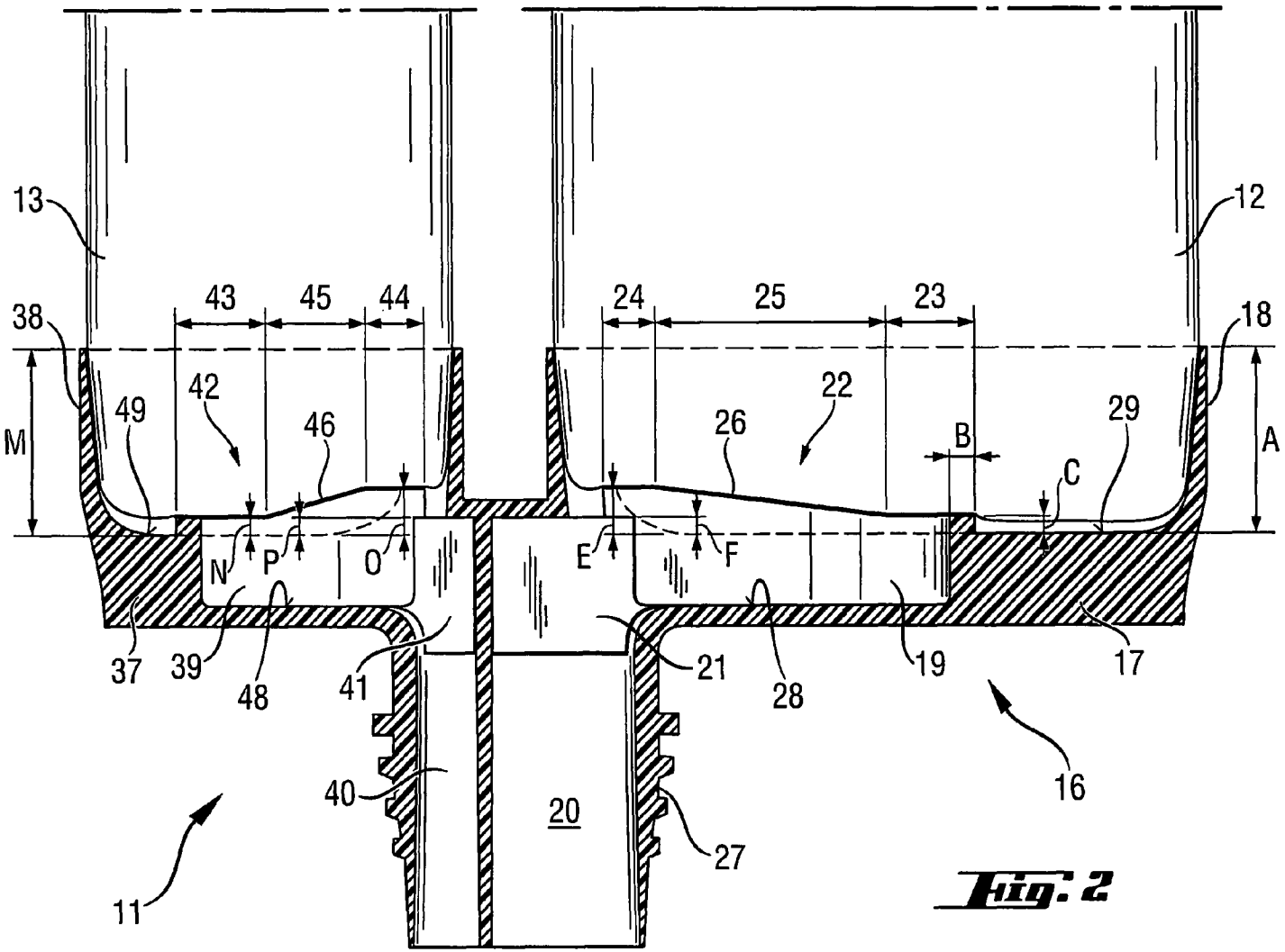
Figure 3:
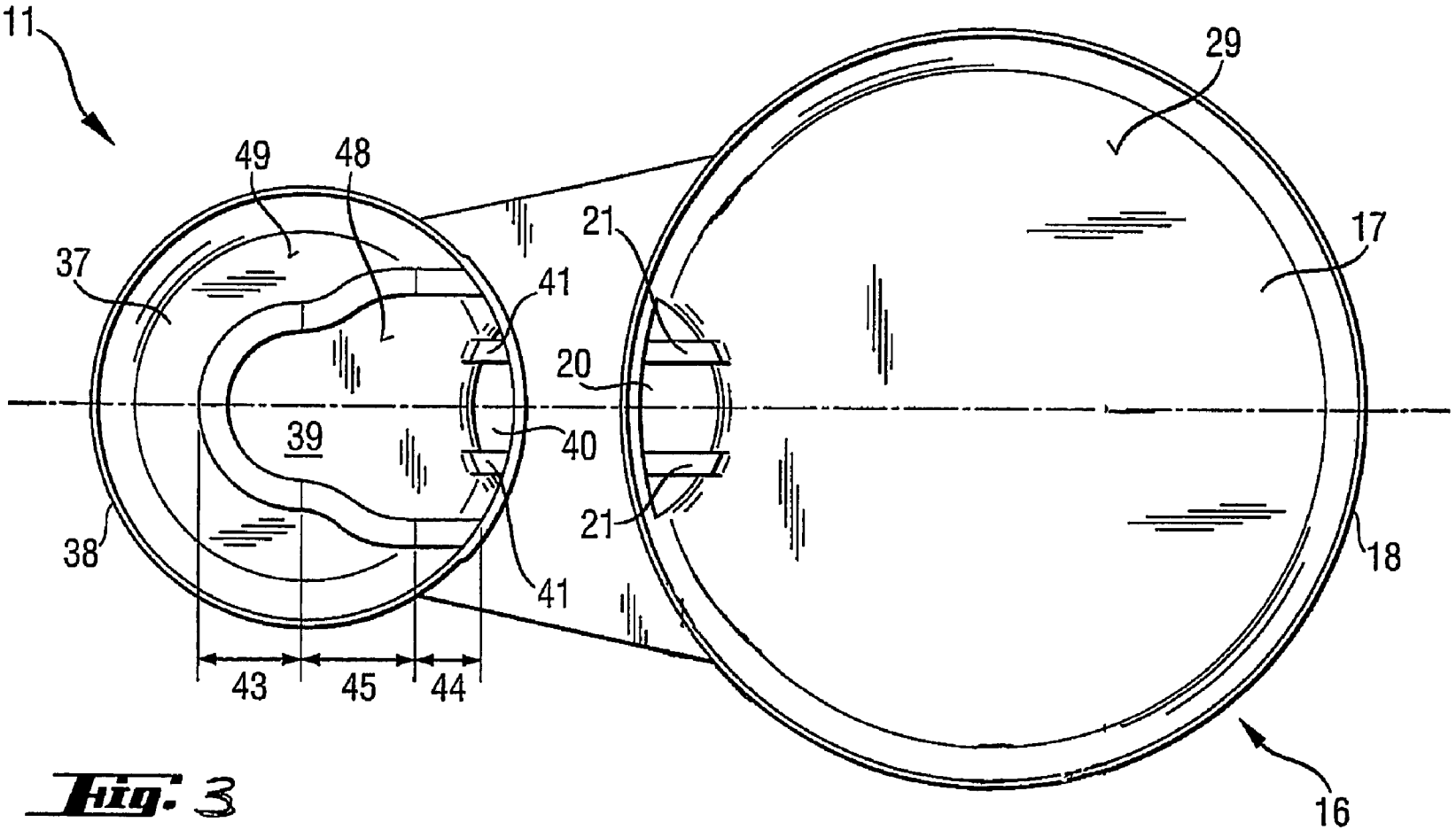

The drawings show:

FIG. 1 a plan view of a head part of a package according to the invention;

FIG. 2 a partial cross-sectional view of the package according to the invention along line II-II in FIG. 1, and FIG. 3 a plan view of a head part of a package according to an alternative embodiment of the invention.

Identical parts are provided with identical reference numerals in the drawings.

DETAILED DESCRIPTION OF THE PREFERRED EMBODIMENT

The package 11, which is shown in FIGS. 1 and 2, has two bags 12 and 13 and a head part 16. The head part 16 has a mixer connector 27 into which two outlet openings 20 and 40 open. The two outlet openings 20 and 40 are provided for the substance to be dispensed.

Further, the head part 16 has a first bottom part 17 with a radially circumferential, axially projecting rim 18 having an axial height A and forming, with the first bottom part 17, a first receiving space for an end area of the bag 12. A recess 19, the outlet opening 20 and two piercing spatulas, which form piercing means 21 for the bag 12, are provided in the first bottom part 17. The piercing means 21 is arranged in the outlet opening 20. Further, an elevation 22 surrounds a rim area of the recess 19 and projects over the first bottom part 17 axially toward the bag 12. The recess 19 forms a passage for the outlet opening 20 in the bottom part 17. The recess 19 has a bottom part 28 which is arranged at a distance from a side 29 of the bottom part 17 facing the bag 12.

The elevation 22 has a first area 23 with a first axial height C and a second area 24 with a second axial height E which is greater than the first axial height C, and a portion 25 which connects the two areas 23 and 24 and which has a continuously extending axial rim 26. The minimum axial height C of the first area 23 of the elevation 22 is 2 mm and corresponds to the axial height F of the piercing device 21 with respect to the first bottom part 17. The axial height E of the second area 24 of the elevation 22 is 4 mm and is smaller than one half of the axial height A of the rim 18 of the first bottom part 17. Further, the elevation 22 has a width B that is selected in such a way that the elevation 22 forms a supporting surface and contact surface for the bag 12 without damaging the latter.

Further, the head part 16 has a second bottom part 37 with a radially circumferential, axially projecting rim 38 having an axial height M and forming, with the second bottom part 37, a second receiving space for an end area of the bag 13. A recess 39, the outlet opening 40 and two piercing spatulas, which form a piercing device 41 for the bag 13, are provided in the second bottom part 37. The piercing device 41 is arranged at the outlet opening 40. An elevation 42 surrounds the rim area of the recess 39 and projects axially over the second bottom part 37 toward the bag 13. The recess 39 forms a passage to the outlet opening 40 on the bottom part 37. The recess 39 has a bottom part 48 which is arranged at a distance from a side 49 of the bottom part 37 facing the bag 13.

The elevation 42 has a first area 43 with a first axial height N and a second area 44 with a second axial height O which is greater than the first axial height N, and a portion 45 which connects the two areas 43 and 44 and which has a continuously extending axial rim 46. The axial height N of the first area 43 of the elevation 42 is 2 mm and corresponds to the axial height P of the piercing device 41 with respect to the second bottom part 37. The axial height E of the second area 44 of the elevation 42 is 3 mm and is smaller than one half of the axial height M of the rim 38 of the second bottom part 37. The exposed axial rim of the elevation 42 forms a supporting surface for the bag 13.

According to an alternative embodiment of a package only one of the recesses, e.g., the recess 39, is at least partially surrounded by an elevation, elevation 42.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A package, comprising at least one bag (12, 13); a head part (16) having a bottom part (17, 37) for at least partially retaining the at least one bag (12, 13) and having a circumferential rim (18, 38) that projects axially toward the at least one bag (12, 13) for receiving an end portion of the at least one bag (12, 13), a recess (19, 39), and an outlet opening (20, 40); and at least one piercing device (21, 41) arranged at the outlet opening (20, 40) for opening the at least one bag (12, 13), wherein the bottom part (17, 37) has an elevation (22, 42) that surrounds at least partially an edge region of the recess (19, 39), projects axially above the bottom part (17, 37), and forms an axial support for the at least one bag (12, 13), wherein a minimum axial height (C, N) of the elevation (22, 42) corresponds to an axial height (F, P) of the piercing device (21, 41), and wherein the elevation (22, 42) has a first section (23, 43) with a first axial height (C, N), a second section a (24, 44)with a second axial height (E, O) which is greater than the first axial height (C, N), and a continuous section (25, 45) connecting the first and second sections (23, 24, 43, 44), the first section (23, 43) of the elevation (22, 42) being provided radially inwardly of the second section (24, 44) of the elevation (22, 42).

2. A package according to claim 1, wherein a maximum height of the elevation (22, 42) corresponds to one half of an axial height of the circumferential rim (18, 38).

3. A package according to claim 2, wherein the further bottom part (37) has an elevation (42) that at least partially surrounds the recess (39) formed in the further bottom part (37) and projects axially above the further bottom part (37).

4. A package according to claim 1, wherein the elevation (22, 42) is radially spaced from the circumferential rim (18, 38).

5. A package according to claim 1, wherein the portion (25, 45) connecting the first and second areas (23, 24; 43, 44) has a continuously extending axial rim (26, 46).

6. A package according to claim 1, comprising at least one further bag (13), and wherein the head part (16) has a further bottom part (37) for at least partially retaining the at least one further bag (13) and provided with a recess (39).

7. A package, comprising two bags (12, 13); a head part (16) having first and second bottom parts (17, 37) for at least partially retaining the two bags, respectively; and two piercing devices (21, 41) for opening the bags (12, 13), respectively, wherein each of the first and second bottom parts (17, 37) has a circumferential rim (18, 38) that projects axially toward a respective bag (12, 13) for receiving an end portion of the respective bag (12, 13), a recess (19, 39) and an outlet opening (20, 40), and a respective piercing device (21, 41) is arranged at the outlet opening (20, 40) for opening the respective bag (12, 13), wherein each bottom part (17, 37) has an elevation (22, 42) that surrounds at least partially an edge region of the recess (19, 39) which projects axially about the bottom part (17, 37) and forms an axial support for the respective bag (12, 13), wherein a minimum axial height (C, N) of the elevation (22, 42) corresponds to an axial height (F, P) of the respective piercing device (21, 41), and wherein the elevation (22, 42) has a first section (23, 43) with a first axial height (C, N), a second section (24, 44) with a second axial height (E,O) which is greater than the first axial height (C, N), and a continuous section (25, 45) connecting the first and second sections (23, 24, 43, 44), the first section (23, 43) of the elevation (22, 42) being provided radially inwardly of the second section (24, 44) of the elevation (22, 42).

* * * * *